US007850158B2

(12) United States Patent
Frei

(10) Patent No.: US 7,850,158 B2
(45) Date of Patent: Dec. 14, 2010

(54) METHOD AND DEVICE FOR SUPPLYING, OPENING AND DEPOSITING FOLDED PRINTED PRODUCTS

(75) Inventor: Hans Frei, Oetwil am See (CH)

(73) Assignee: Ferag AG, Hinwil (CH)

( * ) Notice: Subject to any disclaimer, the term of this patent is extended or adjusted under 35 U.S.C. 154(b) by 538 days.

(21) Appl. No.: 11/683,774

(22) Filed: Mar. 8, 2007

(65) Prior Publication Data

US 2007/0210503 A1 Sep. 13, 2007

(30) Foreign Application Priority Data

Mar. 10, 2006 (CH) ..... 0382/06

(51) Int. Cl.
*B65H 39/00* (2006.01)

(52) U.S. Cl. ..... 270/52.29; 270/52.14; 270/52.16; 270/52.19; 270/52.23; 270/52.25; 270/52.26

(58) Field of Classification Search ..... 270/52.14, 270/52.16, 52.19, 52.23, 52.25, 52.26, 52.29
See application file for complete search history.

(56) References Cited

U.S. PATENT DOCUMENTS 2,163,732 A 6/1939 Kleineberg et al.
4,555,101 A * 11/1985 Stobb ..... 271/12
4,641,825 A * 2/1987 Mowry et al. ..... 270/52.26
4,684,116 A * 8/1987 Hansch ..... 270/52.3
4,775,137 A * 10/1988 Glanzmann ..... 270/52.29
5,052,667 A * 10/1991 Hansch ..... 270/52.3
5,193,851 A * 3/1993 Honegger ..... 281/15.1
5,301,937 A * 4/1994 Hansch ..... 271/204
5,810,345 A * 9/1998 Lehmann et al. ..... 270/52.26

FOREIGN PATENT DOCUMENTS

| | | |
|---|---|---|
| CH | 684085 | 7/1994 |
| DE | 4434178 | 3/1996 |
| DE | 19638448 | 5/1997 |
| EP | 1149785 | 10/2001 |

* cited by examiner

*Primary Examiner*—Leslie A Nicholson, III
(74) *Attorney, Agent, or Firm*—Rankin, Hill & Clark LLP

(57) ABSTRACT

Folded printed products (6) are supplied with trailing fold-edges (6.3) from above towards a clamping gap (1) and are pushed out of the clamping gap (1), in order to be deposited on, for example, saddle-like supports (7). As soon as the leading edge of each printed product (6) exits from the clamping gap (1), the printed product (6) is opened by two printed product parts (6.1 and 6.2) being separated from each other, and the opened printed products are positioned above the support (7). Gripper elements (11) are provided for gripping the trailing fold-edge (6.3) of each printed product (6), before it exits the clamping gap (1), thus preventing a free fall of the printed products (6) onto the support (7) when the trailing fold-edge (6.3) exits the clamping gap (1). The gripper elements (11) grip and guide the printed products towards the support (7). If a plurality of supports (7) is provided, and these are conveyed continuously and in succession past, below the stationary clamping gap (1), the fold-edges (6.3) of the printed products (6) are moved by the gripper elements (11) to track the supports (7).

14 Claims, 3 Drawing Sheets

METHOD AND DEVICE FOR SUPPLYING, OPENING AND DEPOSITING FOLDED PRINTED PRODUCTS

BACKGROUND OF THE INVENTION

1. Field of the Invention

The invention lies in the field of the further processing of printed products, and relates to a method and to a device, which serve for the serial supplying, opening and depositing of folded printed products.

Folded printed products comprise a fold-edge and an open edge located opposite the fold-edge. They comprise two product parts which are connected to one another at the fold-edge, and the folded printed product can be opened by moving the two product parts apart, starting from the open edge.

2. Description of Related Art

According to the state of the art, folded printed products are supplied one after the other, for example to further processing, wherein the printed products are conveyed with trailing fold-edges (e.g. clamped in between two press belts), and are then pushed downwards out of a clamping gap (e.g. nip between two opposite deflection rollers of the press belts) one after the other and with their open edges facing forwards. During exit from the clamping gap, each printed product is at least partly opened (e.g. by fixing at least one product part in the region of the periphery of the deflection rollers) and each opened printed product falls, as soon as its fold-edge has left the clamping gap, onto a support (e.g. a saddle-like support with a saddle line aligned parallel to the clamping gap). Supported by the support, the printed product is then conveyed onwards (e.g. by a suitable movement of the support), and is processed further as the case may be (e.g. brought together with other folded printed products and/or bound).

Folded printed products being folded off-center, so that one product part protrudes at the open edge over the other product part (gripper fold), are usually opened by gripping the protruding product part, which exits first from the clamping gap, at its leading edge using a gripper, and separating it from the other product part. As soon as the leading edge of the protruding product part is sufficiently distanced from the other product part, it becomes possible to grip the other product part at its leading edge and to move it in the opposite direction for further opening the printed product. Depending on the intrinsic stiffness of the two product parts and on the adhesion between the two product parts, printed products can be opened without problem, even if the leading edge of the non-protruding product part is not gripped. Folded printed products which only consist of a single folded sheet, or printed products which are folded several times, may also be opened during exit from the clamping gap with the help of suction devices. Such suction devices act on the outer side of at least one of the product parts and are able to open such products whether they are folded off-center or not.

For further processing of printed products following the supplying, opening and depositing as briefly described above, without problem and in a precise manner the products are usually first aligned, because it is not possible to deposit the printed products on the supports with the necessary precision and each one in exactly the same manner. For printed products deposited on saddle-like supports it is particularly important that the fold-edge of each deposited printed product lies exactly above the saddle line of the support and is aligned to this saddle line. If for example a plurality of folded sheets is successively deposited on a saddle-like support and is then stapled through the fold-edges of the sheets still resting on the saddle-like support, precise stitching is possible only if the fold-edges of all sheets are lying exactly on one another and exactly above the saddle line.

An exact deposition of the printed products becomes particularly difficult when the supports are conveyed below the clamping gap in an essentially continuous manner and the clamping gap is stationary. In such a case, the saddle line moves relative to the clamping gap, whilst a printed product falls towards the support in an essentially unguided manner to be deposited on the support.

The mentioned problem is less pronounced in devices in which the printed products are not pushed out of a clamping gap, but are supplied each being held by a gripper at its fold-edge. This is due to the fact that using the grippers, it is easier to bring the printed products in a guided manner closer to the supports and let them follow the supports better, than is possible using a clamping gap. On the other hand, supply of the products with grippers asks for opening means which are substantially independent of the supply means in order to be able to guide the free edges of the product parts. This renders the device complicated, in particular when the products to be processed are highly flexible and light (i.e. easily influenced by draughts).

In order to be able to achieve the above mentioned high depositing precision also with the clamping gap method, the publication of DE-19638448 (Grapha-Holding) suggests to pivot the saddle-like supports, on being conveyed substantially continuously past below the clamping gap, about an axis being parallel to the saddle line and the clamping gap, and being situated below the saddle line. This pivoting is controlled in such a manner that the saddle line remains below the clamping gap for a longer time, so that the folded printed product can fall onto the support during this time. The disadvantage of this measure lies in the fact that although the alignment of the saddle line and the clamping gap remains unchanged over a certain time, the distance between the saddle line and the clamping gap and in particular the spatial orientation of the saddle-like support change due to the pivoting, which may lead again to inaccurate deposition.

BRIEF SUMMARY OF THE INVENTION

It is the object of the invention to provide a method and a device for supplying, opening and depositing printed products, which method and device are based on known methods and devices serving the same purpose, and on the simple opening methods of these known methods and devices, wherein method and device according to the invention are to allow a higher deposition accuracy than the known methods and devices.

The basic idea of the method according to the invention is a combination of firstly supplying and opening with the aid of a clamping gap, and secondly supplying with held fold-edges, which are possibly moved to track the support which moves relative to the clamping gap.

In the method according to the invention, the printed products are supplied in succession and with trailing fold-edges towards a clamping gap, preferably being clamped between two conveyor means. Each printed product is opened when its leading, open edge exits from the clamping gap, by at least one of the product parts being gripped and moved away from the other product part. Before the trailing fold-edge reaches the clamping gap, this edge is also gripped and after exiting from the clamping gap is guided towards the support in a held manner and it is released from being held only directly above the support. The direction in which the fold-edge is guided after its exit from the clamping gap is directed primarily downwards, but may secondarily have a component aligned parallel to the conveying direction of the supports.

For gripping the trailing fold-edge of the supplied printed products, before this fold-edge leaves the clamping gap, and for guiding this fold-edge from the gap to directly above the support, the device according to the invention comprises at least one gripper element which is driven synchronously with a supply means forming the clamping gap and with an opening means, and possibly with the support. Furthermore, the device according to the invention comprises control means for activating (closing) the at least one gripper element upstream of the clamping gap in order to grip a printed product, and for deactivating (open) the gripper directly above the support in order to release the printed product. It is particularly advantageous to provide a plurality of revolving gripper elements, wherein the circular path of the gripper elements at least directly upstream of the clamping gap, corresponds to the path of the printed products or their fold-edges respectively, which path is defined by the supply means and the clamping gap.

In a preferred embodiment of the device according to the invention, the gripper elements are directly coupled to the supply and opening means, i.e. they move about the same axis as a deflection roller of the supply means, which roller delimits the clamping gap on one side, and, possibly also as a means for gripping the leading edge of one of the product parts for opening the product.

In the preferred embodiment of the invention, the support is saddle-like and is essentially continuously conveyed past, below the clamping gap, wherein a saddle line of the support is aligned in parallel to the clamping gap. A plurality of such supports (e.g. collecting drum, revolving system or linear collecting path) are conveyed one after the other with saddle lines aligned advantageously transversely to the conveying direction. However, all this is not a precondition for the invention. The support may, for example, also be a flat support on which the printed products are deposited fully opened. Or it may be saddle-like and have a saddle line aligned to the clamping gap, but have, relative to the clamping gap, a non-changing position and alignment, wherein a deposited printed product is conveyed away from the clamping gap by being pushed along the saddle line of the support.

The supply means with the clamping gap according to the preferred embodiment of the invention is a pair of press belts, which supply the printed products in a clamped manner, wherein two deflection rollers at the end of the conveying part of the belts define the clamping gap and wherein at least one of these rollers is equipped for opening the printed products in a per se known manner with grippers engaging the leading edges of the printed product parts or with a suitable suction device. This too is not a precondition for the invention. The supply means may be realised in any other manner, but always such that the folded printed products are supplied one after the other, with trailing fold-edges and essentially downwards, and are pushed out of the a clamping gap.

BRIEF DESCRIPTION OF THE DRAWINGS

The method according to the invention and exemplary embodiments of the device according to the invention are hereinafter described in detail by way of the following Figs., wherein.

DETAILED DESCRIPTION OF THE INVENTION

Figure 1:
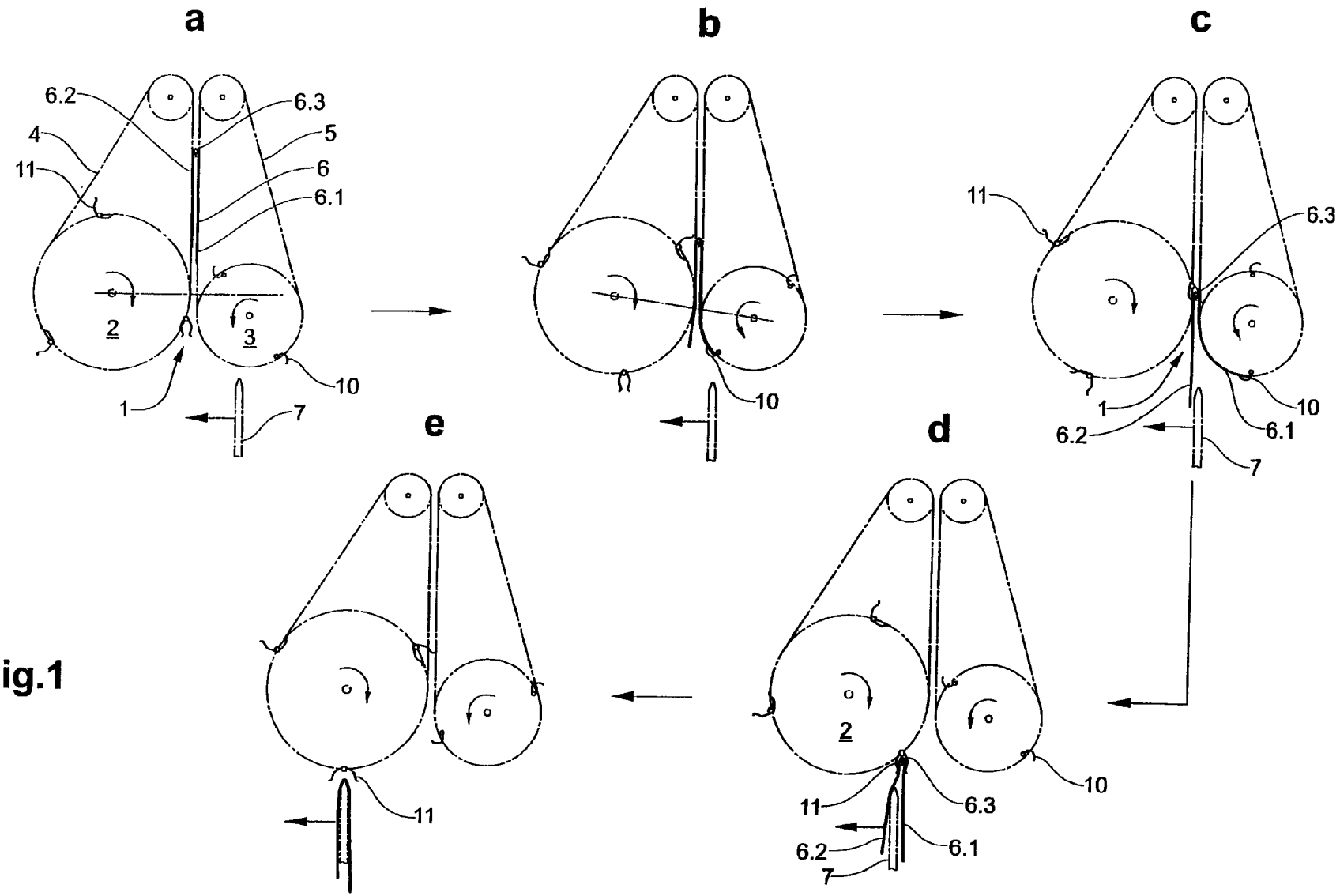
FIG. 1 shows the region of a clamping gap of a preferred embodiment of the device according to the invention, and serves for illustrating the method according to the invention (phases a to e)

FIG. 1 shows consecutive phases, a to e, of the supplying, opening and depositing of a printed product according to the method of the invention wherein the region of the clamping gap 1 of a device according to the invention is depicted. The clamping gap is formed by two deflection rollers 2 and 3 of the press belts 4 and 5, said deflection rollers being pressed towards one another. The one only printed product 6 being shown is folded off center, which means the printed product part 6.1 facing towards the press belt 5 is somewhat longer than the other product part 6.2. Saddle-like supports 7 (only one is shown) are conveyed past, below the clamping gap 1, wherein the saddle lines of the supports are aligned perpendicularly to the plane of the drawing and in parallel to the clamping gap 1, and wherein the conveying direction of the supports 7 is directed perpendicular to the alignment of the clamping gap 1 and the saddle lines and from the clamping gap side of the deflection roller 3 to the clamping gap side of the deflection roller 2. The speeds of the press belts 4 and 5 or the peripheral speeds of the two deflection rollers 2 and 3 respectively are the same.

Gripper elements 10 for gripping the leading edge of the longer printed product part 6.1 revolve aligned essentially to the path of press belt 5, around the deflection roller 3 in a manner which is essentially known. Gripper elements 11 for gripping the trailing fold-edges 6.3 of the printed products revolve in essentially the same manner, i.e. aligned to the path of the press belt 4 around the deflection roller 2. The press belts 4 and 5 and their deflection rollers 2 and 3 are for example narrower than the printed products to be treated, and these printed products protrude on both sides from between the press belts 4 and 5, so that they can be gripped by the gripper elements 11 in these protruding regions. It is, however, also possible for each press belt to be designed as a plurality of part belts distanced to one another, and to let the gripper elements 11 engage the printed products in the gaps between the part belts.

In phase "a" of the method, the complete printed product 6 is still located in the supply means (above the clamping gap), i.e. it is conveyed downwards towards the clamping gap being clamped between the press belts 4 and 5, wherein the fold-edge 6.3 is the trailing edge. The supply direction is oriented vertically downwards.

In phase "b", the leading edges of both printed product parts 6.1 and 6.2 have passed the clamping gap 1 and directly after this passage or during the passage, the leading edge of the printed product part 6.2 has been gripped by the gripper element 10 and in the represented moment is moved along the path of the gripper element 10 which corresponds to the periphery of the deflection roller 3, and by way of this is distanced from the other printed product part, such that the printed product is opened. The fact that a straight connecting line between the axes of the deflection rollers 2 and 3 is not perpendicular to the supply direction contributes to the opening of the printed product or to the separation of the two printed product parts respectively. By way of this, the printed product, on being pushed through the clamping gap 1, is bent away from the supply direction to the direction of a contact tangent between the two deflection rollers (perpendicular to the named connecting line). This results in the printed product part 6.2 not held by a gripper being bent away from the held printed product part 6.1.

In phase "c", the printed product 6 is advanced so far from the clamping gap 1, that the printed product part 6.1 which hangs downwards essentially vertically has reached the level of the saddle line of the support 7, wherein the printed product part 6.1 is held above this level by being guided along the path of the gripper elements 10. The trailing fold-edge 6.3 has arrived directly above the clamping gap 1, and is gripped by the gripper element 11 and accompanied through the clamping gap 1.

In phase "d", the printed product part 6.2 is securely positioned on the leading side of the support 7, and the printed product part 6.1 being released from gripper element 10 on the trailing side of the support. The fold-edge 6.3 is still held by the gripper element 11 and is guided along the path of this gripper element, which essentially corresponds to the periphery of the deflection roller 2. This means that the fold edge is guided on the one hand downwards, i.e. towards the saddle line of the support 7, and on the other hand it follows or tracks the support 7 in the conveying direction.

In phase "e", the gripper element 11 has reached the lowermost point (release location) of its circular path. Conveyance of the supports and the path and movement of the gripper element 11 are matched to one another such that in this moment, the support allocated to the printed product is situated perpendicularly below the gripper element 11 and is distanced as little as possible to this. The gripper element 11 is deactivated or opened in this moment, so that the printed product is deposited on the support 7 essentially without any free-fall.

Of course, it is not only one printed product which is supplied, opened and deposited as represented in FIG. 1, but there are many printed products, which are supplied with as small as possible distances to one another, are opened one after the other and are deposited on a support 7 each, wherein a plurality of supports are conveyed in succession past, below the clamping gap in an essentially continuous manner, one support being associated to each printed product. Thus in phase "e", a following product would have to be illustrated about as shown for phase "b", and a further following product as shown for phase "a". Furthermore, downstream printed products deposited on downstream supports would have to be depicted also.

As can be deduced from the phases, a to e, of FIG. 1, the gripper elements 11 are not only to be arranged for being activated and deactivated, but also for being pivoted relative to their path, at least in the region of this path, in which they hold the fold-edge of the associated printed product. In the region of the clamping gap, they are to be aligned to a printed product part directed tangentially to their circular path, and in the region of the release, to a printed product part aligned radially to their circular path.

As already mentioned above, for opening the printed product, gripper means for leading edges may not only be provided in the region of the deflection roller 3, but also in the region of the deflection roller 2. At least one of the deflection rollers 2 and 3 may also be designed for suctioning a product part in order to open the printed products.

Figure 2:
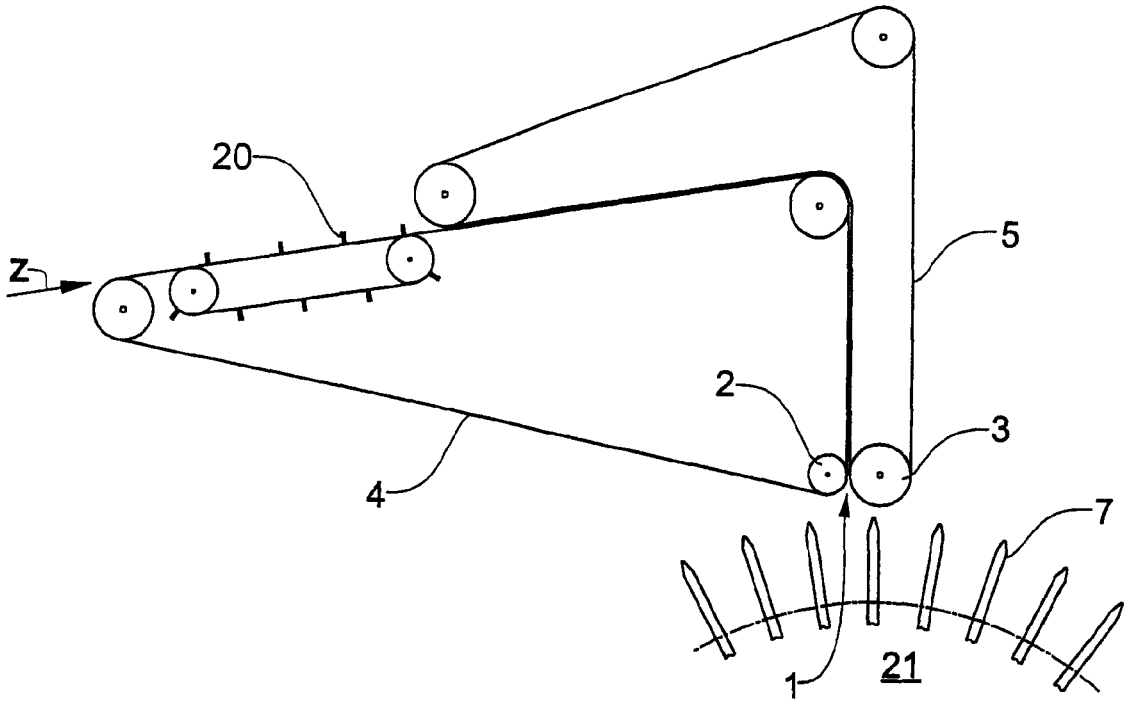
FIG. 2 shows a first, exemplary embodiment of the device according to the invention.

FIG. 2 shows a preferred embodiment of the device according to the invention, whose clamping gap region, for example, corresponds to the clamping gap region represented in FIG. 1. The printed products (not shown) are, for example, conveyed from a feeder (not shown) in a supply direction Z onto the press belt 4, and, before they are clamped between the press belts 4 and 5, are aligned in the conveying direction by way of revolving aligning cams 20 (setting of exact distances between consecutive printed products). The printed products pushed out of the clamping gap 1 are for example deposited on the saddle-like supports of a collecting drum 21.

Figure 3:
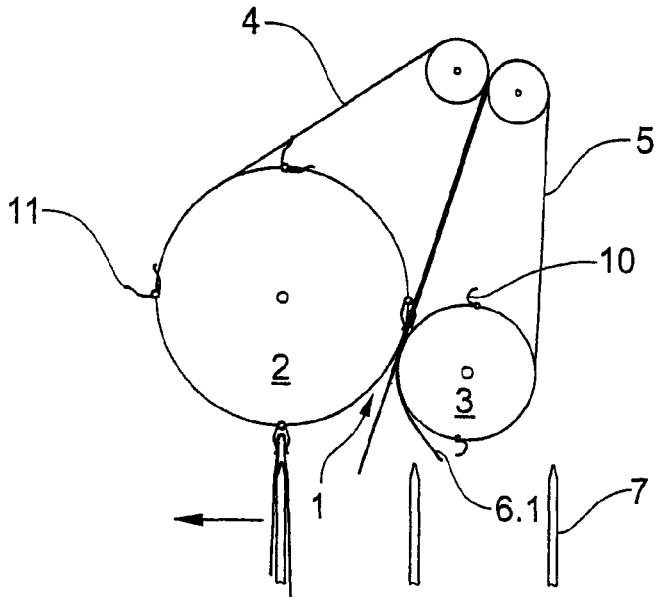
FIGS. 3 to 5 show clamping gap regions of further exemplary embodiments of the device according to the invention.

FIG. 3 shows the clamping gap region of a further, exemplary embodiment of the device according to the invention. This differs from the clamping gap region represented in FIG. 1 by the supply direction not being oriented vertically downwards, but slanted downwards in the direction of the conveying of the supports 7. Furthermore, the deflection roller 2 comprises four gripper means 11 for gripping the trailing fold-edges, and the deflection roller 3 comprises two gripper means 10 for gripping leading edges (ratio of deflection roller diameters 2:1), whilst according to FIG. 1, three gripper means 11 and two gripper means 10 are provided (ratio of deflection roller diameters 3:2).

Figure 4:
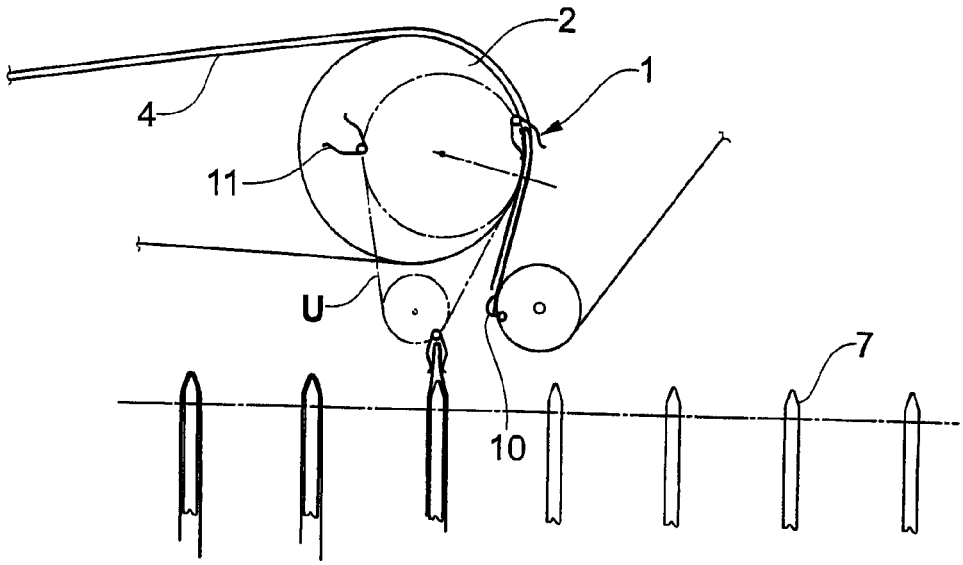

FIG. 4 shows the clamping gap region of a further, exemplary embodiment of the device according to the invention. Here, the clamping gap 1 is not formed by two deflection rollers, but by one deflection roller 2 and a press belt 5 running essentially in a straight line. The revolving path (dot-dashed line U) of the gripper elements 11 for gripping the trailing fold-edges does not correspond to the periphery of a deflection roller, but has an essentially straight-lined region between the clamping gap 1 and the lowest point (release location) where the printed products are released. This makes it possible to adapt the speed of the gripper elements 11 exactly to the speed of the continuously conveyed supports 7, in a manner such that the only relative movement between the held fold-edge of a printed product to be deposited, and a support, is a movement directed vertically downwards.

Figure 5:
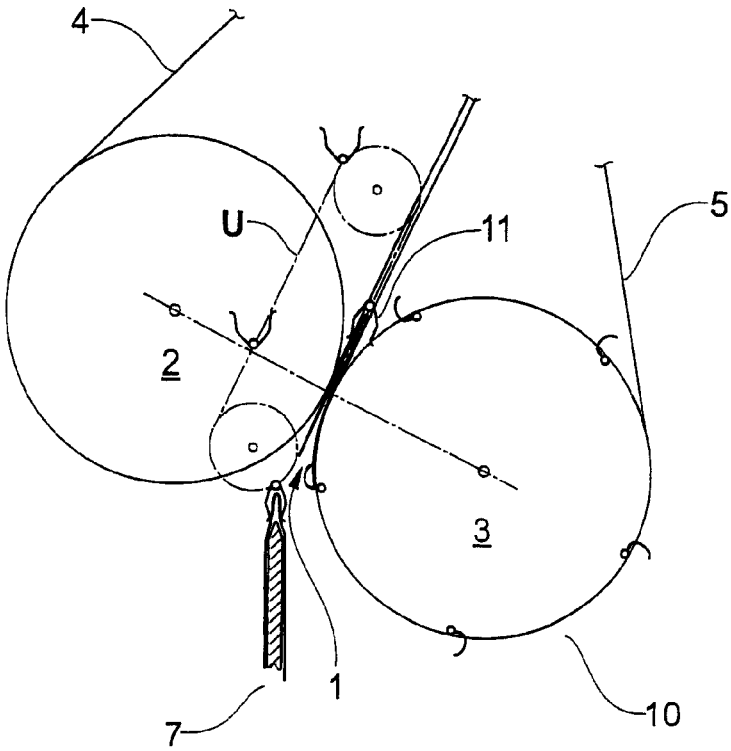

FIG. 5 likewise shows the clamping gap region of a further, exemplary embodiment of the device according to the invention. In this case too, the circular path (dot-dashed line U) of the gripper elements 11 for gripping the trailing fold-edges of the printed products does not correspond to the periphery of one of the deflection rollers 2 or 3, but, between the clamping gap 1 and the lowest point (release location) where the printed products are released, has a straight-lined region, in this case oriented in the supply direction. This embodiment of the clamping gap region is in particular suitable for depositing the printed products on a stationary support 7. Each printed product deposited on this support is displaced perpendicularly to the plane of the drawing before a following product is positioned. For this displacement, for example, suitably arranged pushers (not shown) are provided. A further printed product may be deposited on the displaced product from a further clamping gap arranged further downstream and/or the displaced printed product may be processed in any suitable manner further downstream.

In the clamping gap 1, according to FIG. 5, the printed products are not bent as this has been described for the embodiment according to FIG. 1. Here, the direction in which the printed products are supplied towards the clamping gap and also the direction in which the trailing fold-edges are guided away from the clamping gap is perpendicular to the straight connecting line between the axes of the two deflection rollers 2 and 3, which means that these two directions lie on the contact tangent of the two deflection rollers.

The invention claimed is:

1. A method for supplying, opening and depositing folded printed products (6) comprising two product parts (6.1, 6.2) being connected along a fold-line (6.3), the method comprising the steps of:

supplying the printed products (6) in succession from above, and with trailing fold-edges (6.3) between two press belts, and towards a clamping gap, wherein the printed products, including at the trailing fold-edges, are clamped by and between a combination of the press belts, pushing the supplied printed products through a clamping gap (1), and opening each printed product being pushed through the clamping gap at least partly, by gripping at least one of the product parts (6.1, 6.2) having passed through the clamping gap, gripping the trailing fold-edge (6.3) of each printed product (6) before and while being pushed through the clamping gap (1) and guiding this trailing fold-edge (6.3) from the clamping gap (1) towards a support (7) while still in a held manner, and depositing each at least partly opened printed product on the support (7) by releasing the trailing fold-edge (6.2) from being gripped.

2. The method according to claim 1, wherein a plurality of saddle-like supports (7) are provided, each support (7) comprising a saddle line aligned in parallel to the clamping gap (1), wherein the supports (7) are conveyed in succession and essentially continuously past, below the clamping gap (1), and wherein the trailing fold-edges (6.3) of the printed products (6) are guided in a held manner to track the saddle lines of the supports (7).

3. The method according to claim 1, wherein the printed products (6) are bent away from the supply direction to the direction of a contact tangent between two deflection rollers on being pushed out of the clamping gap (1).

4. The method according to claim 1, wherein, on being supplied, the printed products (6) are aligned in a supply direction (Z).

5. A device for feeding, opening and depositing folded printed products (6) comprising two product parts (6.1, 6.2) being connected along a fold-line, the device comprising:

a supply device including two press belts (4 and 5) with a clamping gap (1) for clamping the printed products, including at the fold-line, between the press belts (4 and 5), and the supply device being equipped for supplying the printed products (6) in succession from above towards the clamping gap (1) and for pushing the printed products through the clamping gap (7), a device for opening the printed products, the opening device being equipped for gripping at least one product part (6.1, 6.2) of each printed product being pushed through the clamping gap, at least one support (7) being arranged below the clamping gap (1) and, a plurality of revolving gripper elements (11) defining a circular path (11) being equipped for gripping the trailing fold-edge (6.3) of each printed product (6) before and while being pushed through the clamping gap (1), for guiding the trailing fold-edge (6.3) in a held manner from the clamping gap (1) towards the support (7), and for releasing the fold-edge (6.3) in the region of the support (7), wherein, in the region of the clamping gap (1), the circular path (11) of the revolving gripper elements (11) is adapted to a course of the supply means.

6. The device according to claim 5, wherein a plurality of supports (7) are provided, wherein the supports (7) are saddle-like and comprise saddle lines aligned in parallel with the clamping gap (1), and wherein the supports (7) are driven to be conveyed in succession past, below the clamping gap (1).

7. The device according to claim 5, wherein the clamping gap (1) is formed by two deflection rollers (2 and 3) of the press belts (4 and 5).

8. The device according to claim 7, wherein a direction in which the press belts (4 and 5) run into the clamping gap (1) is slanted relative to a connecting straight line between axes of the two deflection rollers (2 and 3), so that the printed products (6) are bent away from the supply direction to the direction of a contact tangent between two deflection rollers on passage through the clamping gap (1).

9. The device according to claim 5, wherein the clamping gap (1) is formed by a deflection roller of the one of the press belts (4), and an essentially straight-lined part of a revolving path of the other press belt (5).

10. The device according to claim 5, wherein the circular path of the gripper elements (11) for gripping the fold-edges (6.3) of the printed products (6) is adapted to a periphery of one of two deflection rollers (2 or 3) of the press belts (4 and 5).

11. The device according to claim 5, wherein the circular path of the gripper elements (1) for gripping the fold-edges (6.3) of the printed products comprises a straight-lined region between the region of the clamping gap (1) and a release location, where the gripper elements (11) are deactivated for releasing the printed products (6).

12. The device according to claim 5, wherein the gripper elements (11) are pivotable relative to their circular path.

13. The device according to claim 5, wherein the opening device comprises further revolving gripper elements (10), which are equipped for gripping a leading edge of at least one of the printed product parts (6.1 or 6.2) of the printed products (6).

14. The device according to claim 13, wherein the supply device further comprises two deflection rollers, and wherein a circular path of the further gripper elements (10) for gripping the leading edges of the printed product parts (6.1 or 6.2) is adapted to a periphery of at least one of two deflection rollers (2 or 3) of the press belts (4 or 5).

* * * * *